US012722853B2

(12) United States Patent
Rivera

(10) Patent No.: US 12,722,853 B2
(45) Date of Patent: Sep. 1, 2026

(54) DOORKNOB DELIVERY TRAY

(71) Applicant: Luis Rivera, Parkland, FL (US)

(72) Inventor: Luis Rivera, Parkland, FL (US)

( * ) Notice: Subject to any disclaimer, the term of this patent is extended or adjusted under 35 U.S.C. 154(b) by 0 days.

(21) Appl. No.: 18/228,214

(22) Filed: Jul. 31, 2023

(65) Prior Publication Data

US 2025/0042616 A1 Feb. 6, 2025

(51) Int. Cl.
*B65D 25/22* (2006.01)
*B65D 1/36* (2006.01)

(52) U.S. Cl.
CPC ..... *B65D 25/22* (2013.01); *B65D 1/36* (2013.01)

(58) Field of Classification Search
None
See application file for complete search history.

(56) References Cited

U.S. PATENT DOCUMENTS 1,671,775 A * 5/1928 Meikle ..... B65D 33/14 383/81
5,409,161 A * 4/1995 Haskett ..... A47G 29/1203 232/1 C
5,509,528 A * 4/1996 Weisburn ..... B65D 25/22 206/45.24
D501,106 S 1/2005 Suero, Jr.
2004/0094555 A1* 5/2004 Raches ..... A47L 15/502 220/487
2007/0029327 A1* 2/2007 Belokin ..... B65D 25/22 220/483
2012/0267331 A1* 10/2012 Cittadino ..... A47F 5/10 220/752
2020/0115106 A1* 4/2020 Goldstein ..... B65D 21/086

OTHER PUBLICATIONS https://www.amazon.com/Home-X-Forget-Door-Knob-Organizer/dp/B00Q0BIT2Y.
https://www.amazon.com/Kikkerland-Doorknob-Pocket/dp/B07YGNFT8J.

* cited by examiner

*Primary Examiner* — Bryon P Gehman
(74) *Attorney, Agent, or Firm* — Edison Law Group, PLLC

(57) ABSTRACT

A doorknob delivery tray meant for the contactless delivery of various food and drink products without having to set the food or drink on the ground wherein the hanging back component may be removed and reattached to accommodate different door orientations and has suction cups on the back of the tray to provide additional support for the weight of food and drink.

7 Claims, 17 Drawing Sheets

DOORKNOB DELIVERY TRAY

PRIOR ART

While different forms of door caddies are known in the prior art, there hasn't been a door caddy specifically designed for food and drink deliveries. For example, U.S. Pat. No. 5,409,161 is a door caddy, however, it is designed to hold a rolled-up newspaper. U.S. D 501,106 is a door caddy, however, it isn't designed to hang from a doorknob.

There are also other doorknob caddies on the market, however, they have layered pockets and are designed to hold things like your keys and other small objects you wouldn't want to forget.

SUMMARY OF THE INVENTION

The present subject matter is a doorknob delivery tray meant for the contactless delivery of various food and drink products without having to set the food or drink on the ground.

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

As described herein, the term "pivotally connected" shall be used to describe a situation wherein two or more identified objects are joined together in a manner that allows one or both of the objects to pivot, and/or rotate about or in relation to the other object in either a horizontal or vertical manner.

As described herein, the term "removably coupled" and derivatives thereof shall be used to describe a situation wherein two or more objects are joined together in a non-permanent manner so as to allow the same objects to be repeatedly joined and separated.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

The present subject matter comprises of a hanging back component 45 which is connected to the backside of the holding tray 50. This hanging back component is connected to the tray using removably coupled connector clips 40.

These connector clips allow for the hanging back component to be reassembled in a manner that allows the delivery doorknob tray to accommodate different door orientations.

The hanging back component further comprises of a clip for notes or receipts 30.

The holding tray comprises of two outer drink compartments (55, 60) meant to hold a drink each and an inner food compartment 65 designed to hold an ordinary fast-food bag.

The present subject matter has two suction cups (10, 15) on the backside of the delivery tray to provide additional support when needed.

The bottom of the tray comprises of a wire basket 25 or a high-density polyethylene with cutouts to allow for drainage 20 of fluids in the event of a spill.

In some embodiments, a disposable version of the present subject matter may be made with cardboard.

The overall height of the present subject matter from the bottom of the tray to the apex of the hanging back component is 15 inches. The total width of the tray and hanging back component is also 15 inches. The height of the tray in isolation is 3.42 inches. The depth of the tray is 4 inches.

In some embodiments, when the present subject matter is constructed of cardboard, the doorknob deliver tray may have a hook that is designed to be used with a left or right sided doorknob.

In some embodiments, the tray has a receipt clip.

The foregoing detailed description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation.

The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom.

LIST OF ELEMENTS

Figure 1:
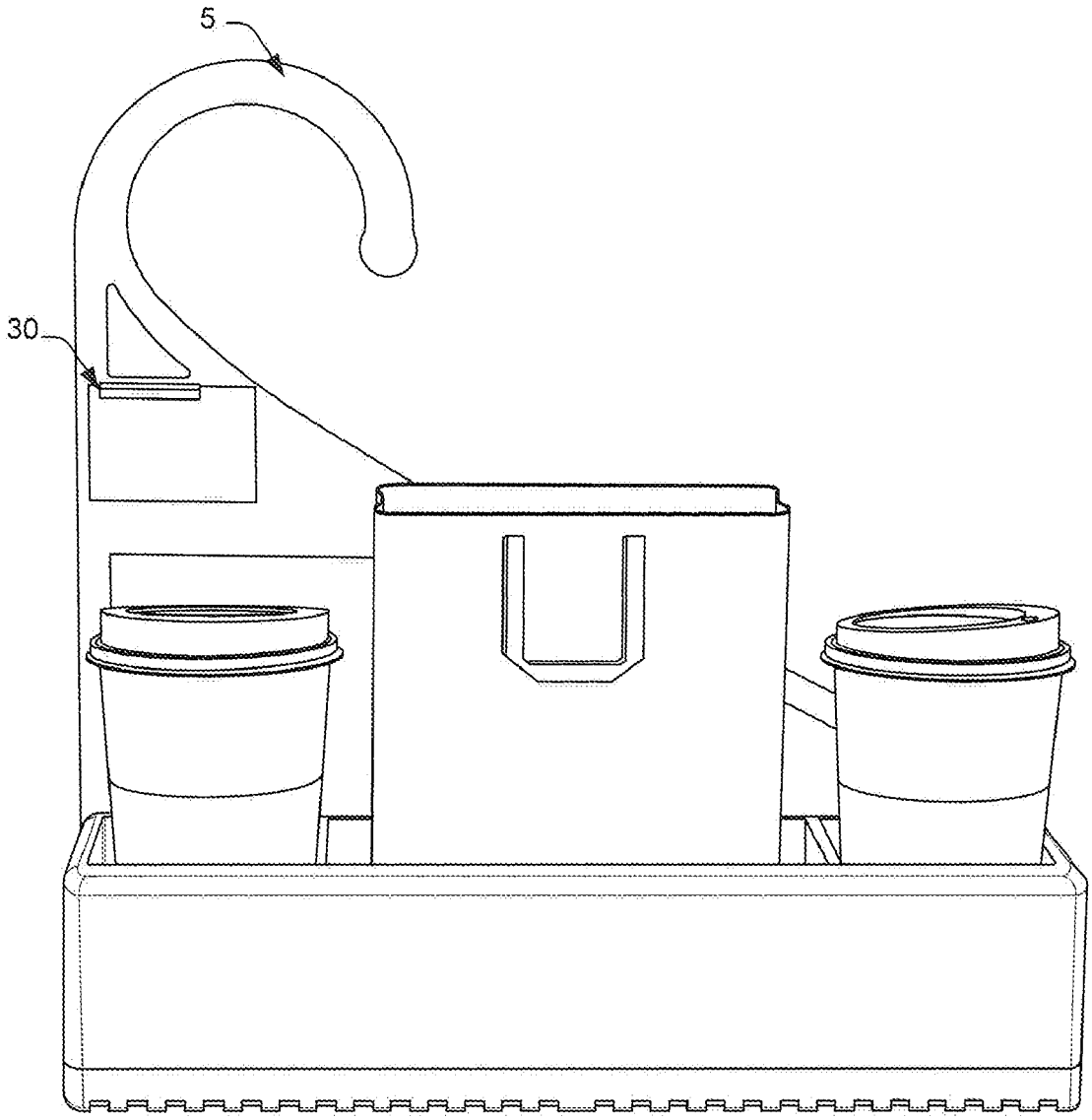
FIG. 1 shows a front view of the doorknob delivery tray with two drinks and a bag inside.
Figure 2:
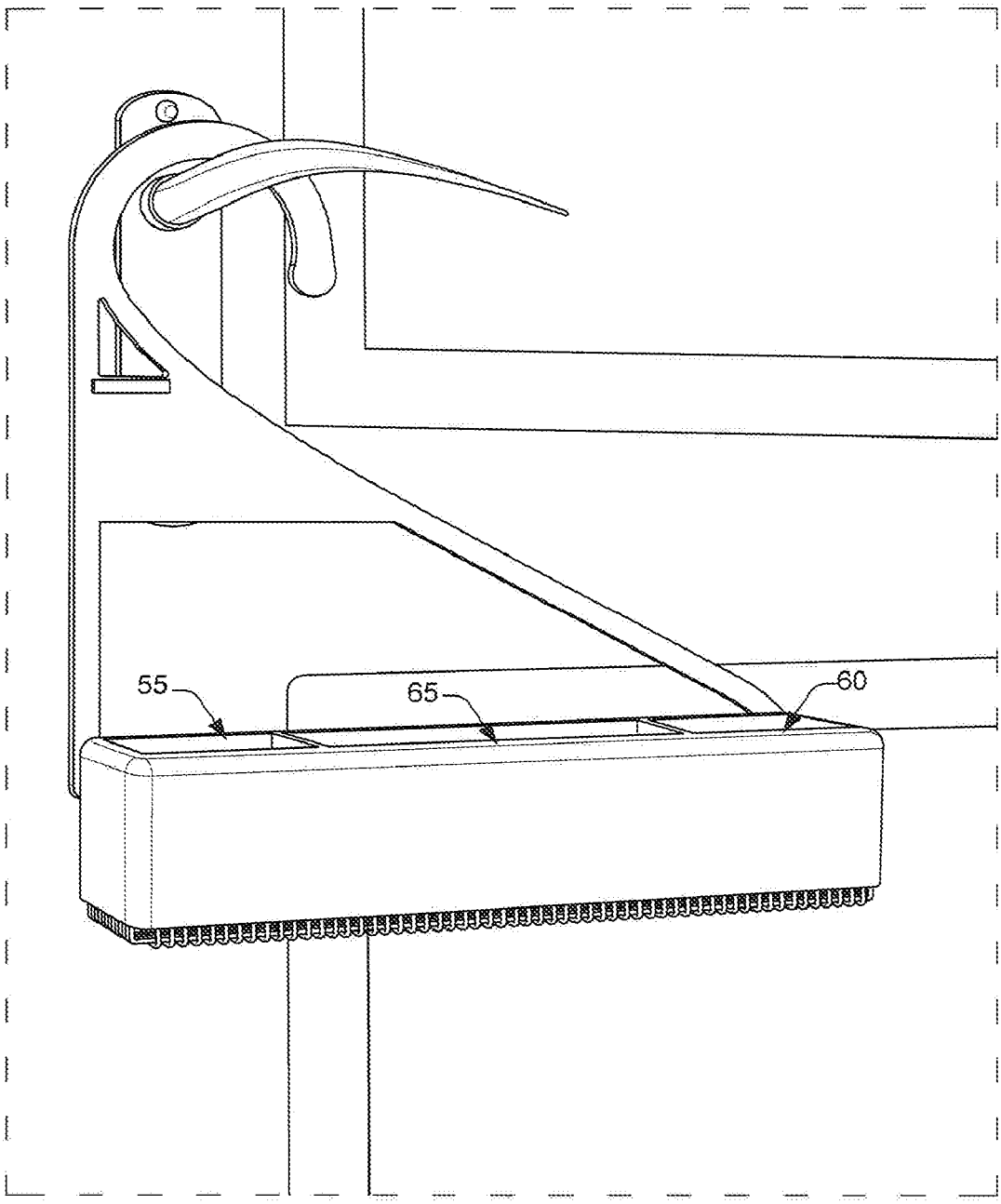
FIG. 2 shows a front view of the doorknob delivery tray on a door.
Figure 3:
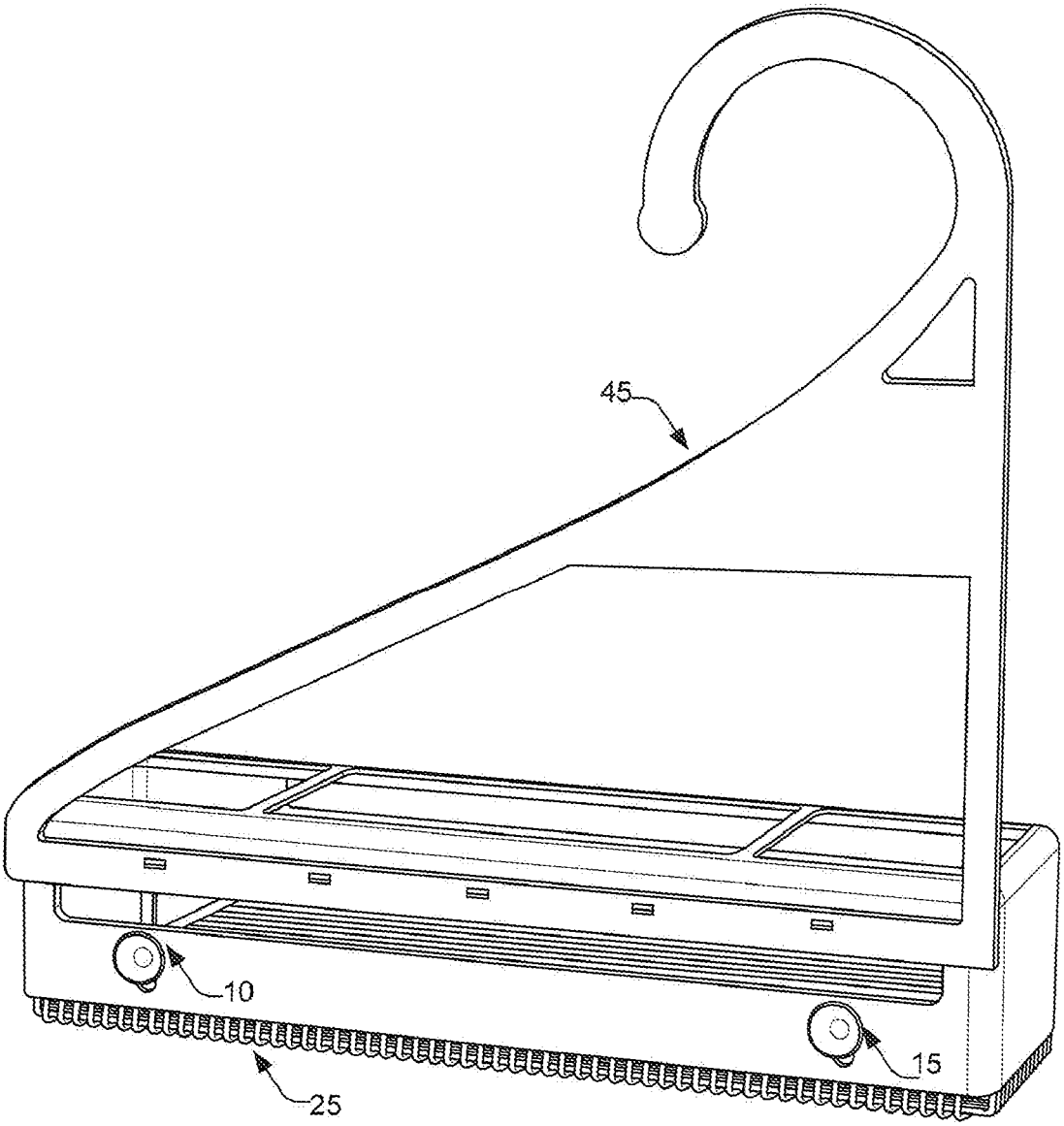
FIG. 3 shows a perspective back view of the doorknob delivery tray with the suction cups affixed to the tray.
Figure 4:
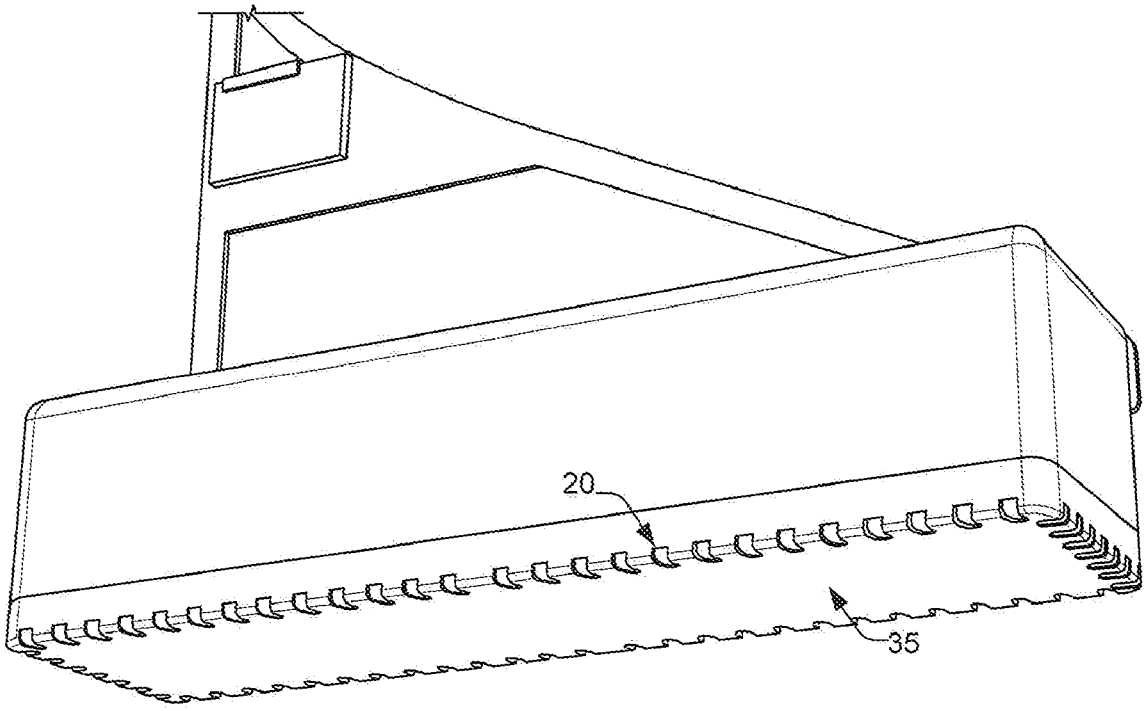
FIG. 4 shows a perspective view of an embodiment of the high-density polyethylene bottom.
Figure 5:
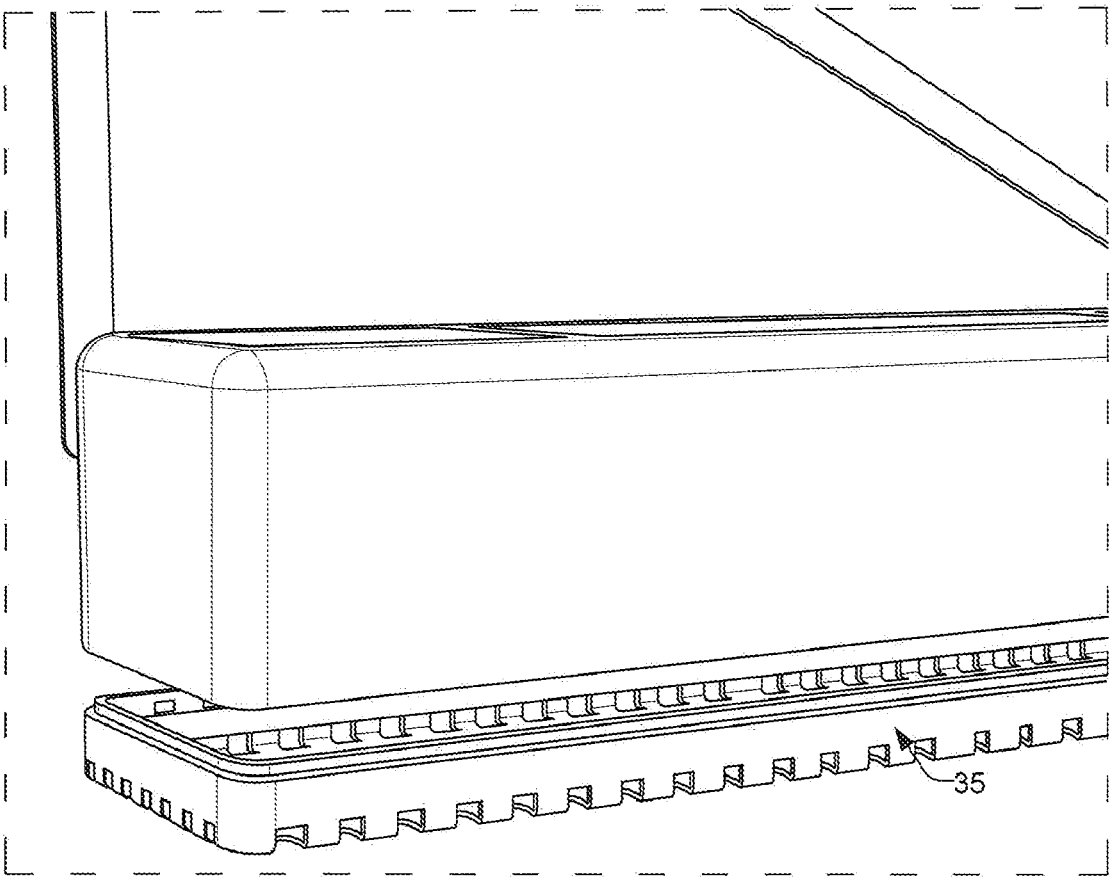
FIG. 5 shows a perspective view of the high-density polyethylene bottom being removed.
Figure 6:
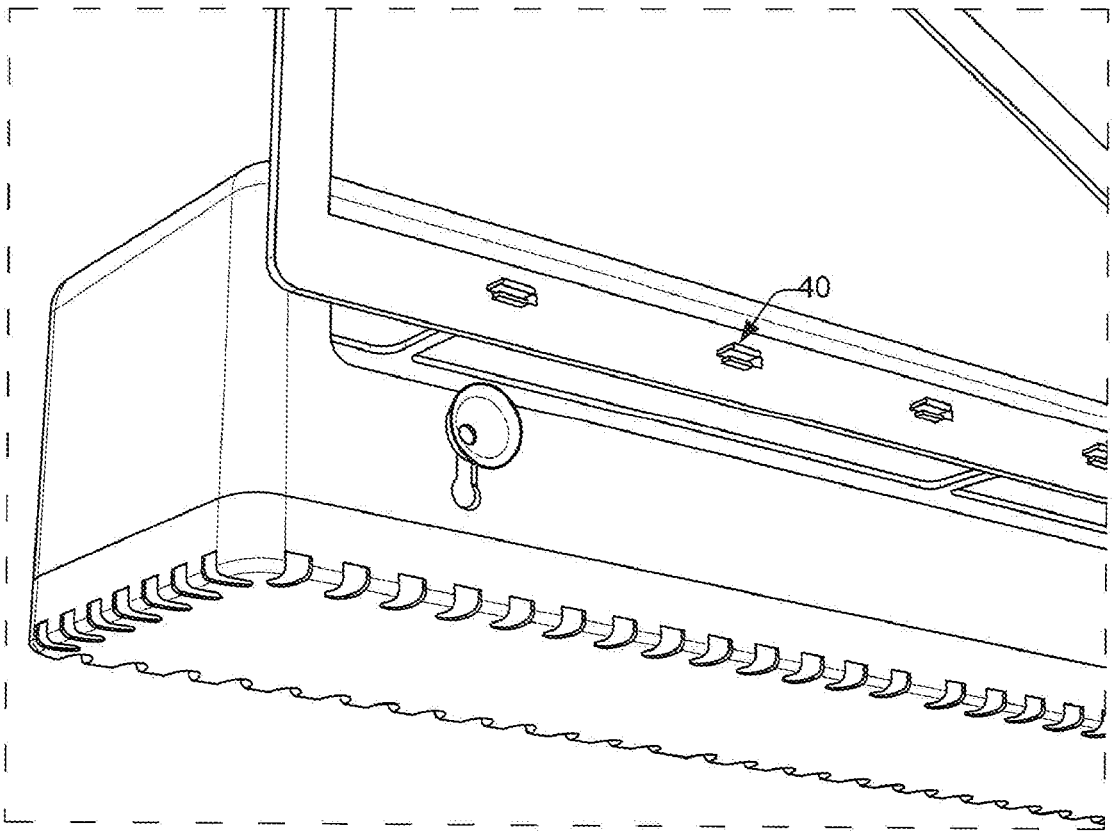
FIG. 6 shows a perspective back view of the doorknob delivery tray with the suction cups affixed to the tray.
Figure 7:
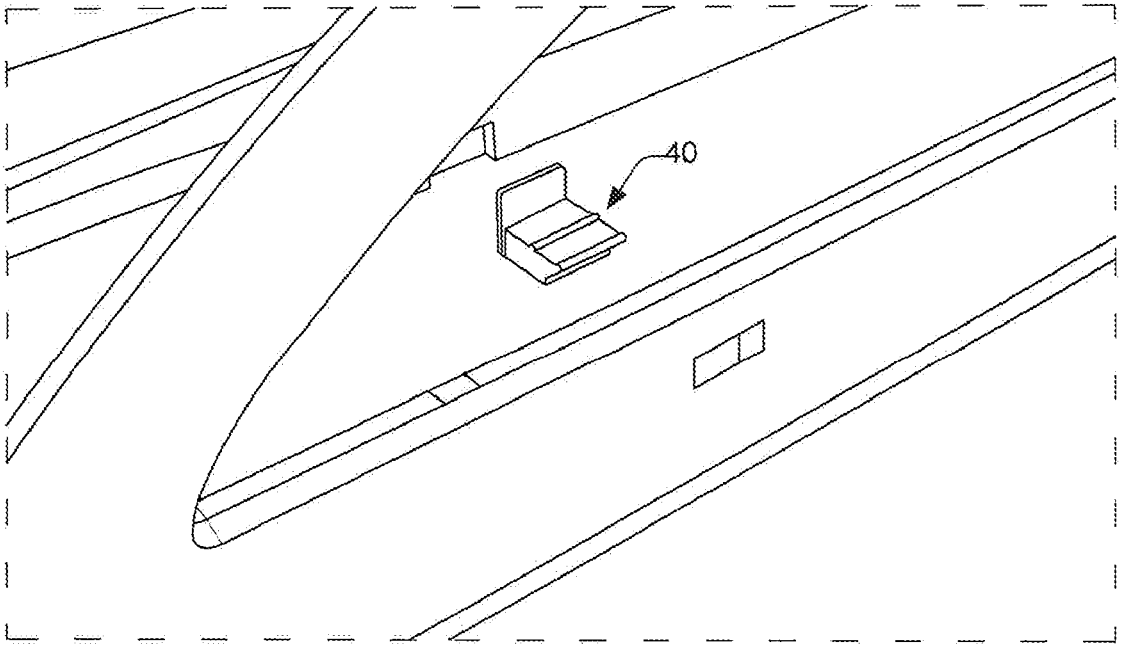
FIG. 7 shows a perspective view of the removably coupled connector clips.
Figure 8:
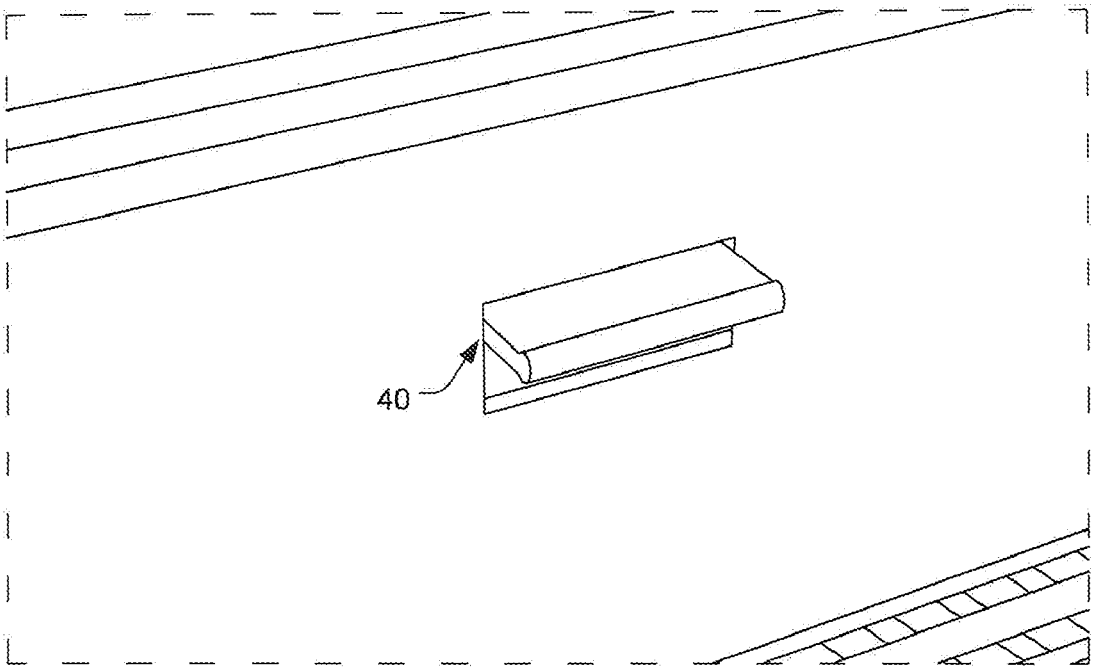
FIG. 8 shows a perspective view of the removably coupled connector clips.
Figure 9:
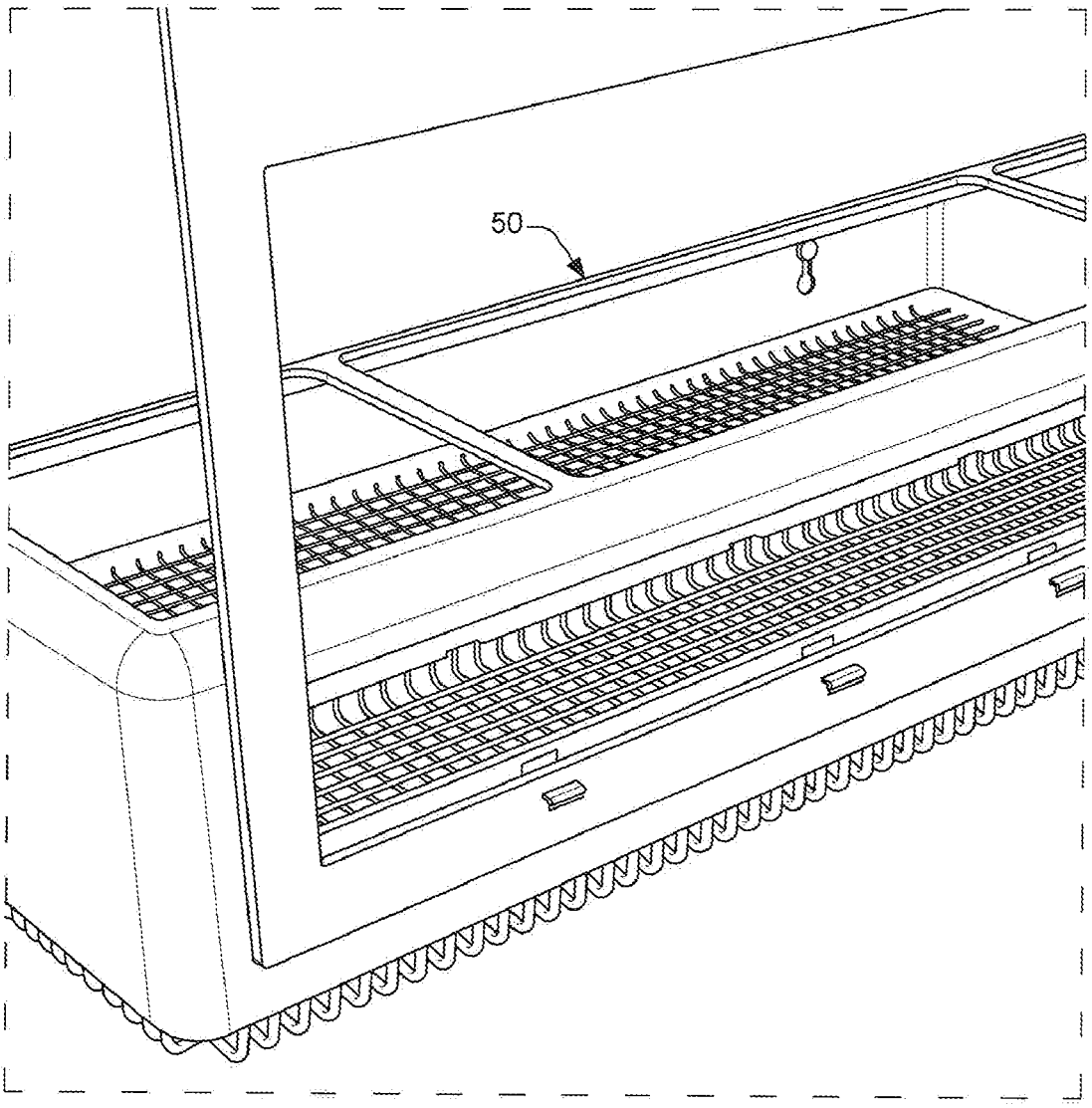
FIG. 9 shows how the removably coupled connector clips attach the tray and the hanging back component together.
Figure 10:
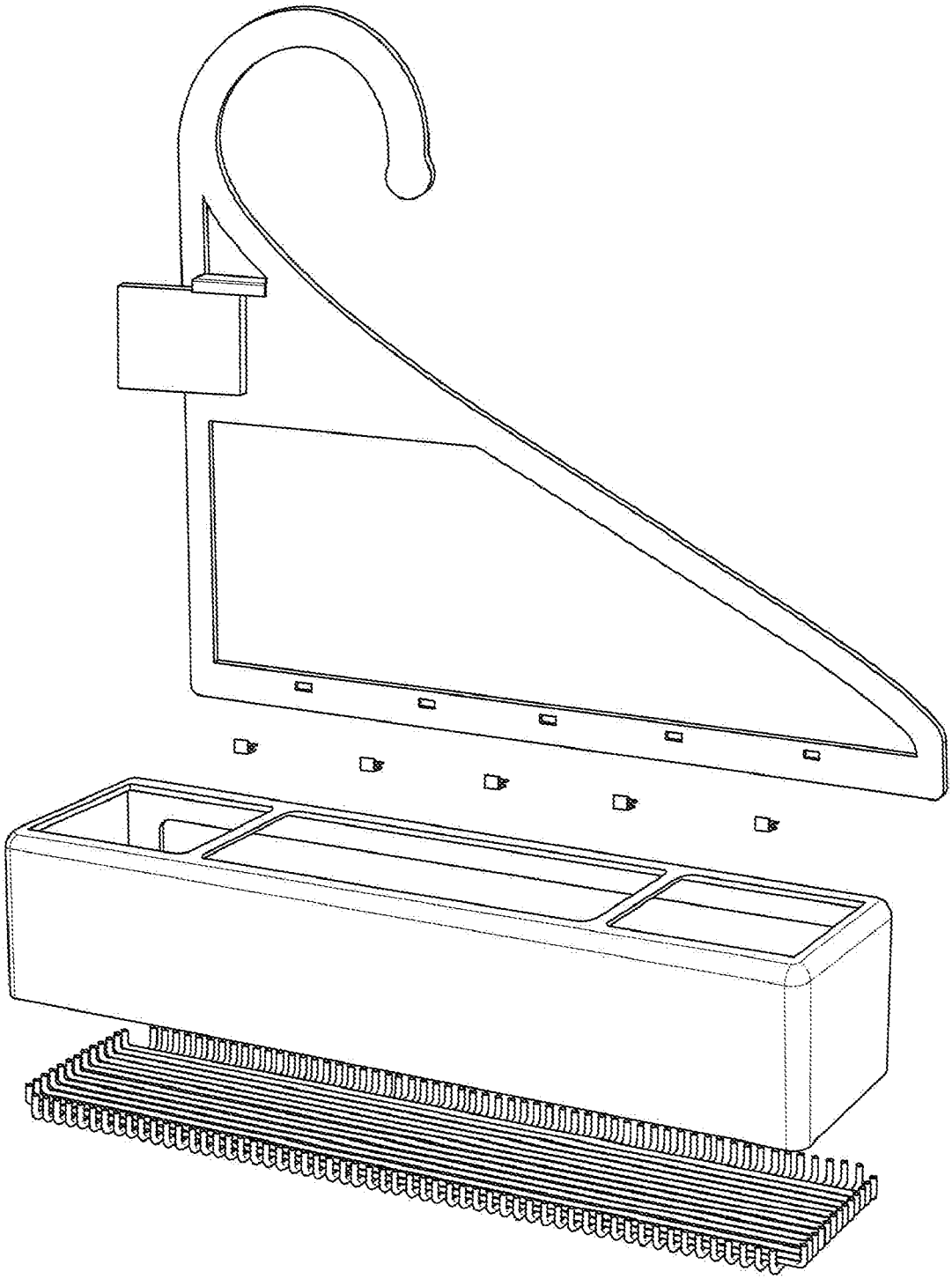
FIG. 10 shows an exploded view of the doorknob delivery tray.
Figure 11:
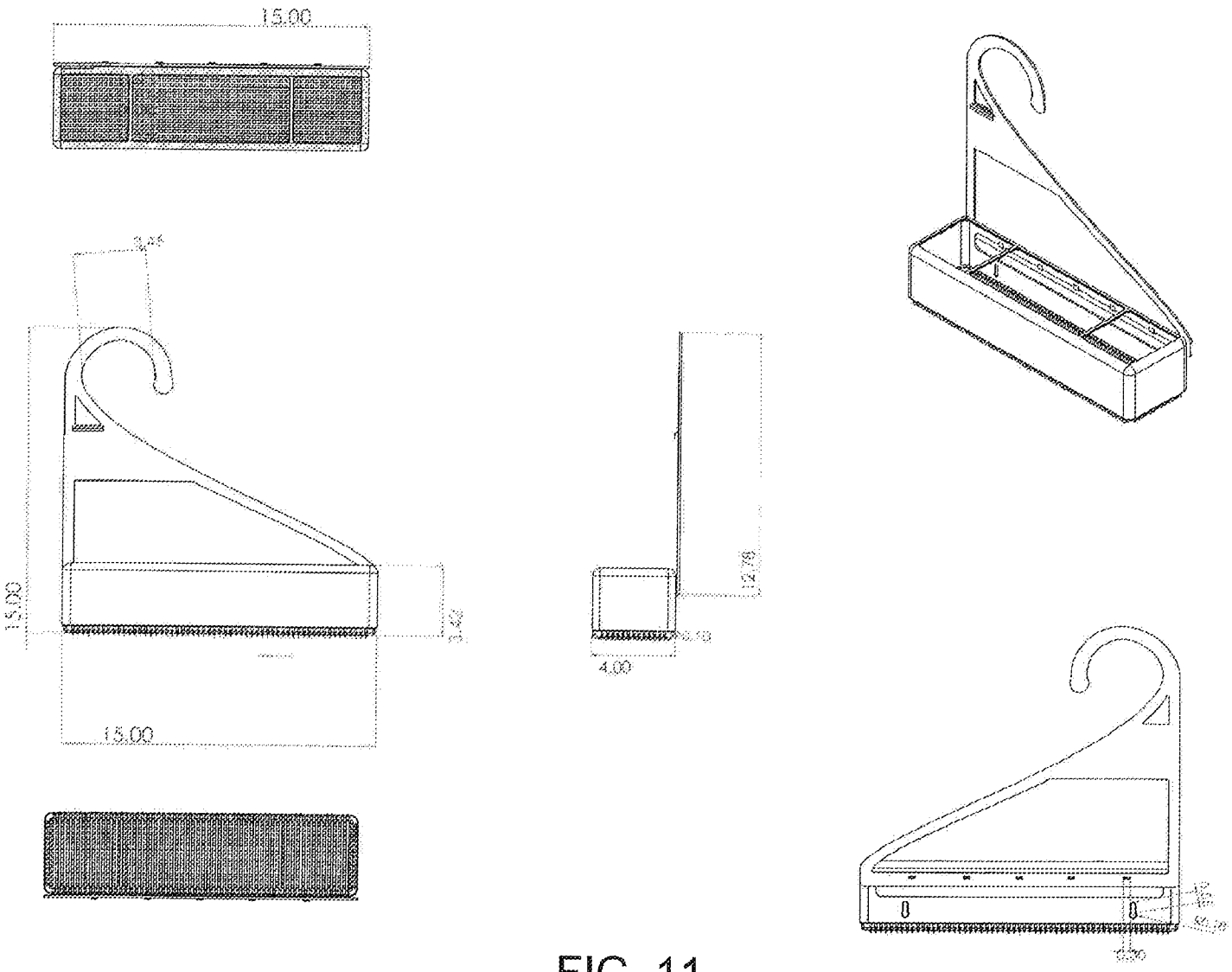
FIG. 11 shows the dimensions of the doorknob delivery tray.
Figure 12:
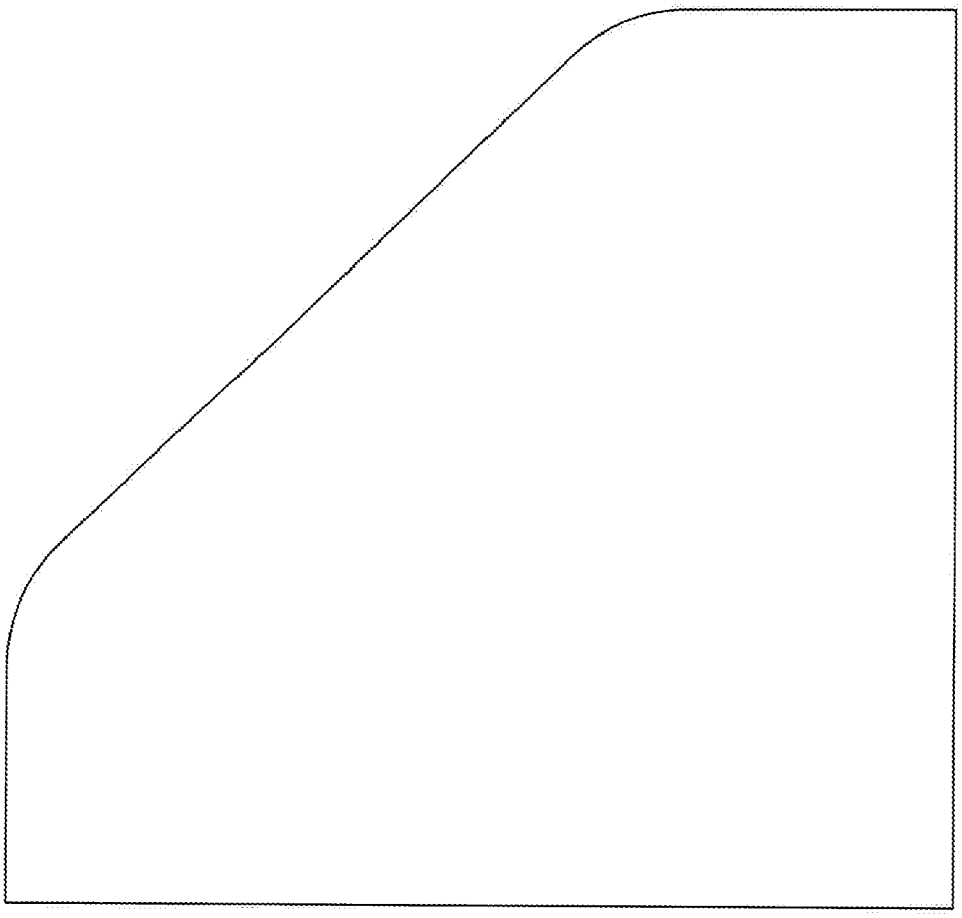
FIG. 12 shows a side view of the disposable doorknob delivery tray.
Figure 13:
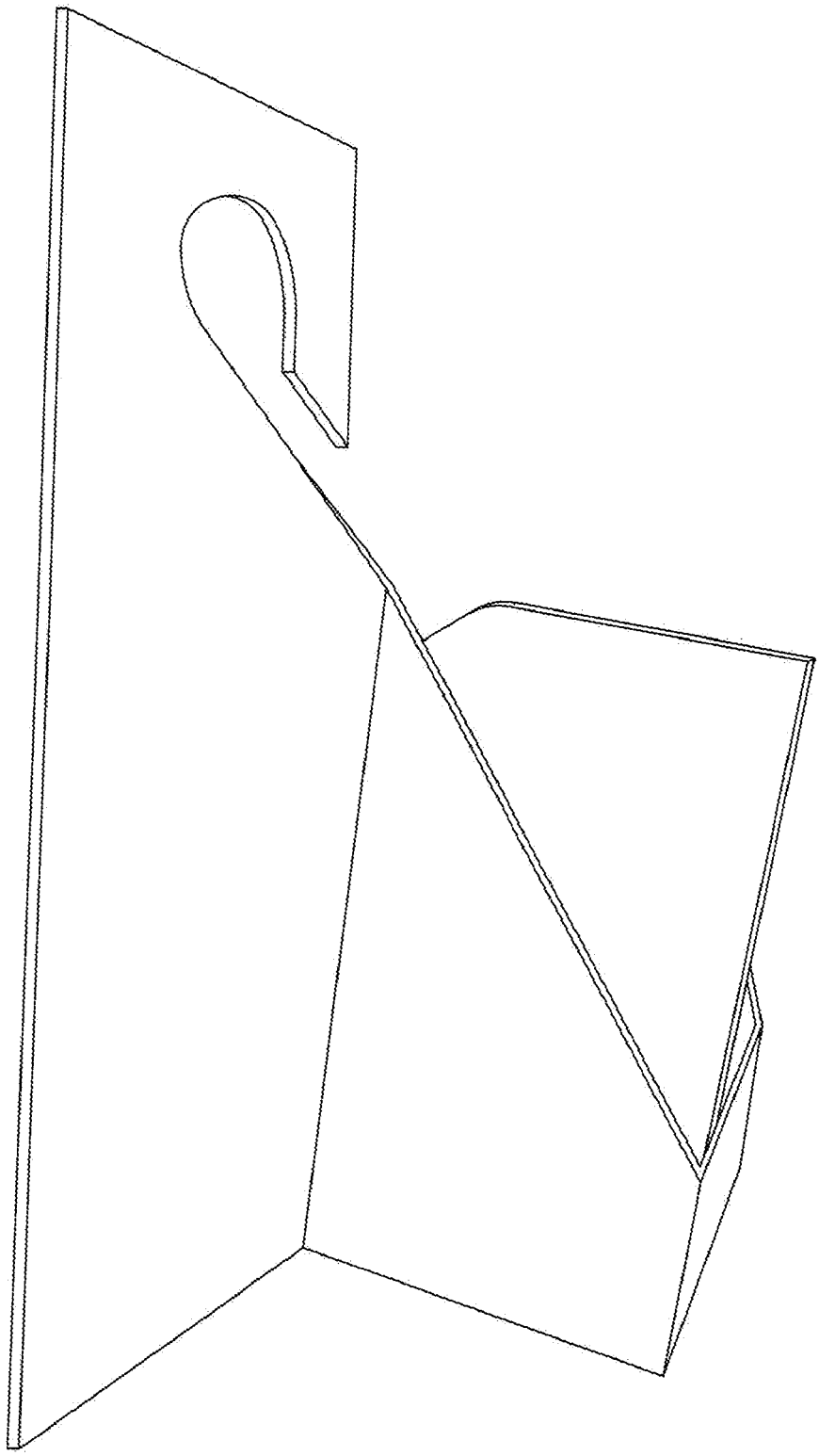
FIG. 13 shows a back perspective view of the partially unfolded disposable doorknob delivery tray.
Figure 14:
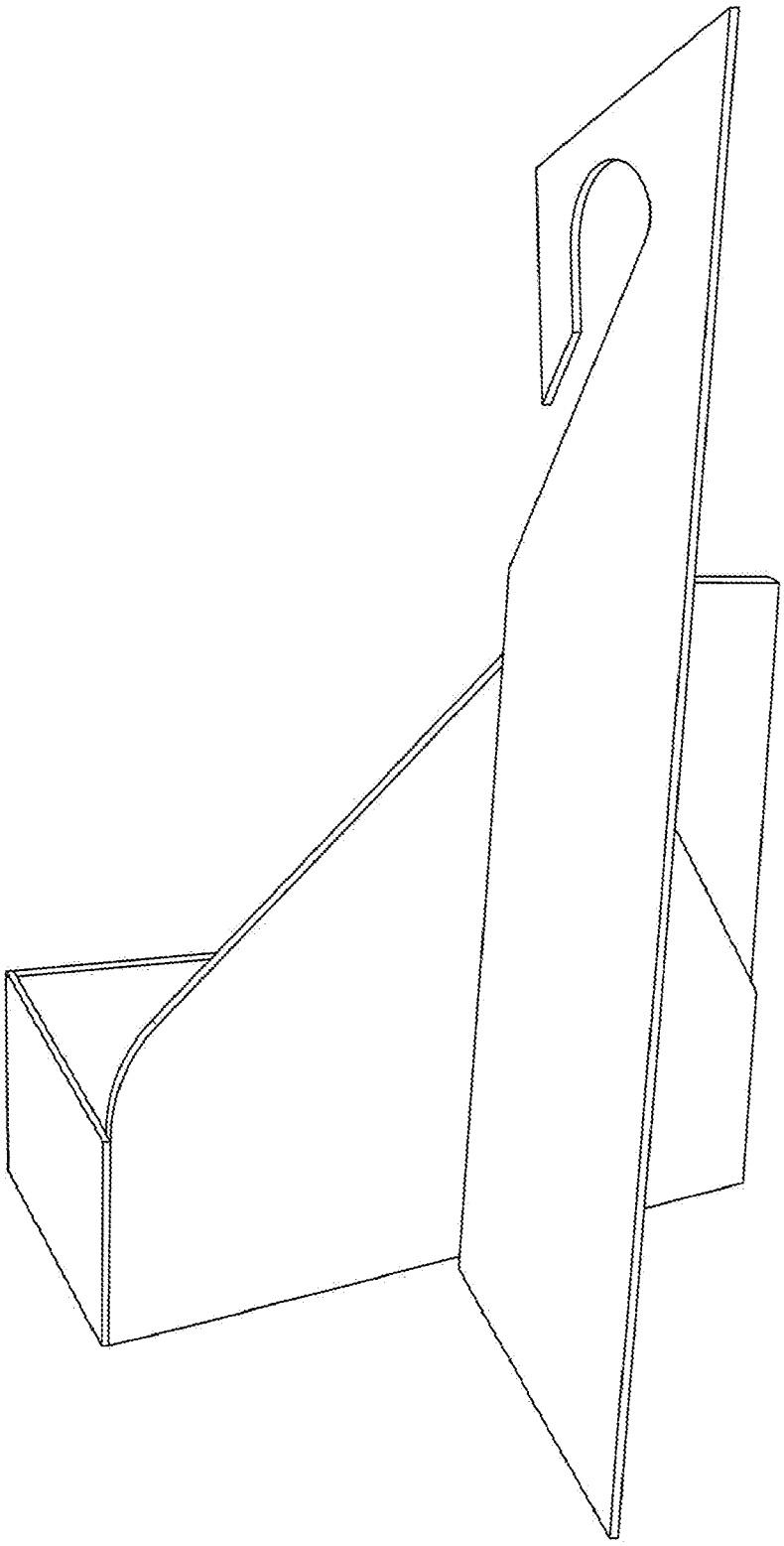
FIG. 14 shows a back perspective view of the partially unfolded disposable doorknob delivery tray.
Figure 15:
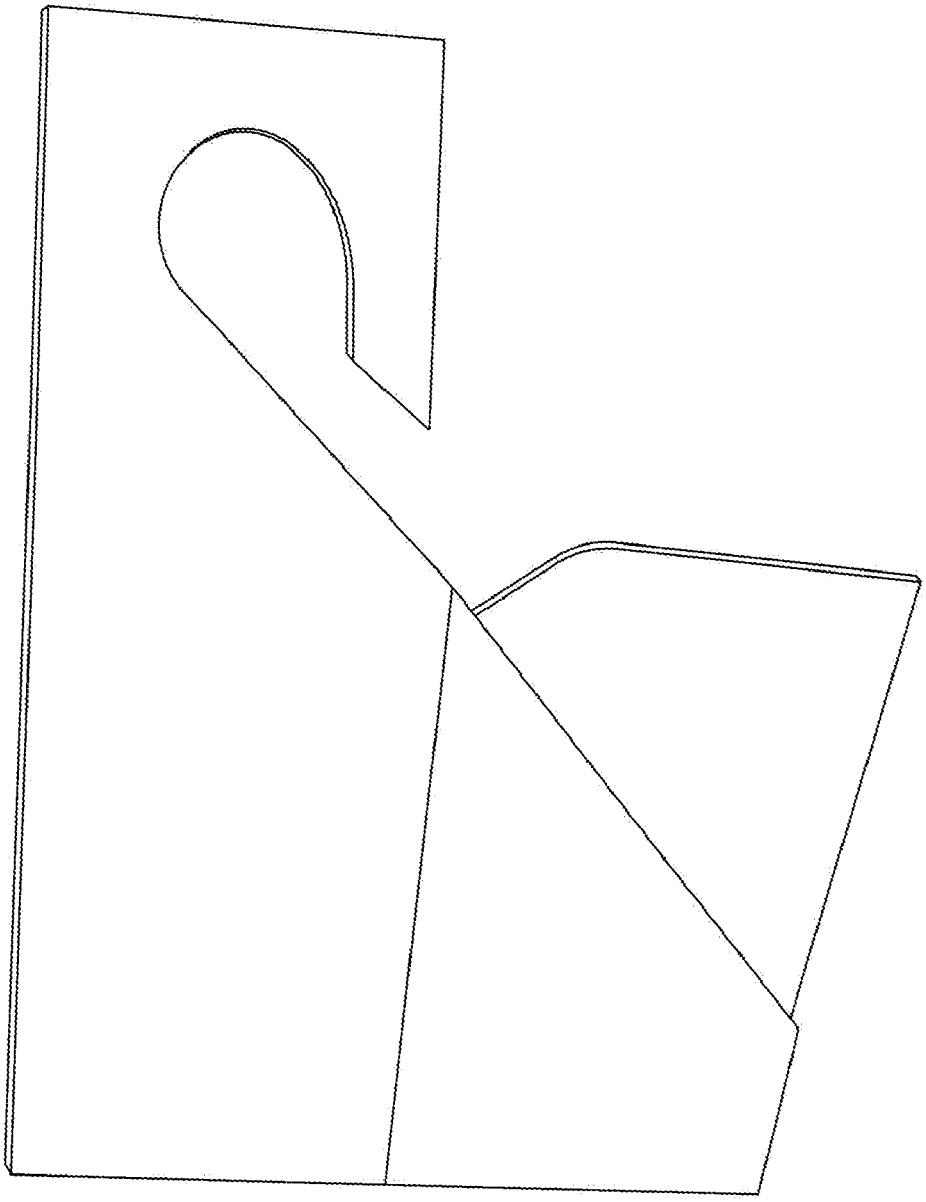
FIG. 15 shows a back view of a flattened disposable doorknob delivery tray.
Figure 16:
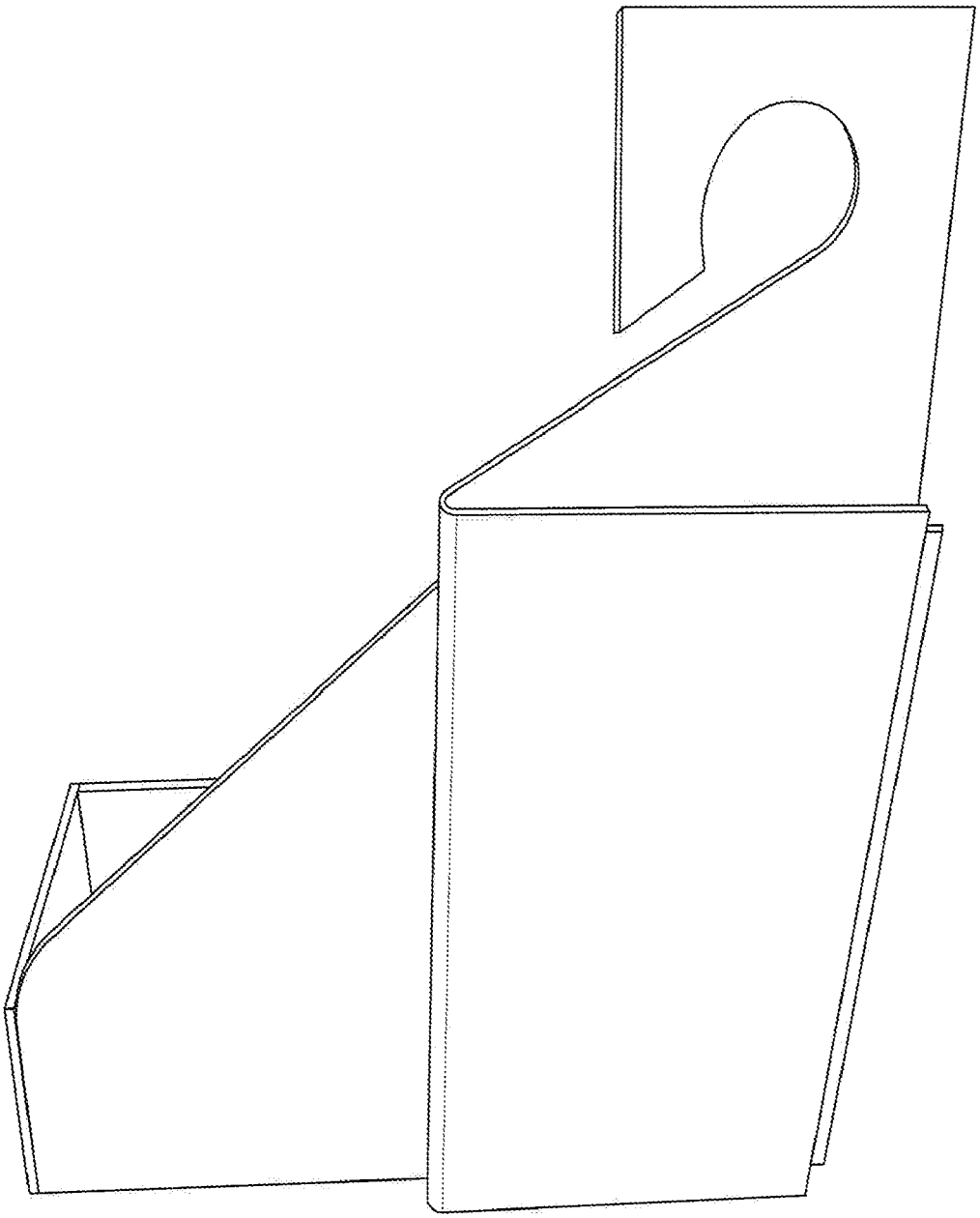
FIG. 16 shows a back perspective view of the disposable doorknob delivery tray.
Figure 17:
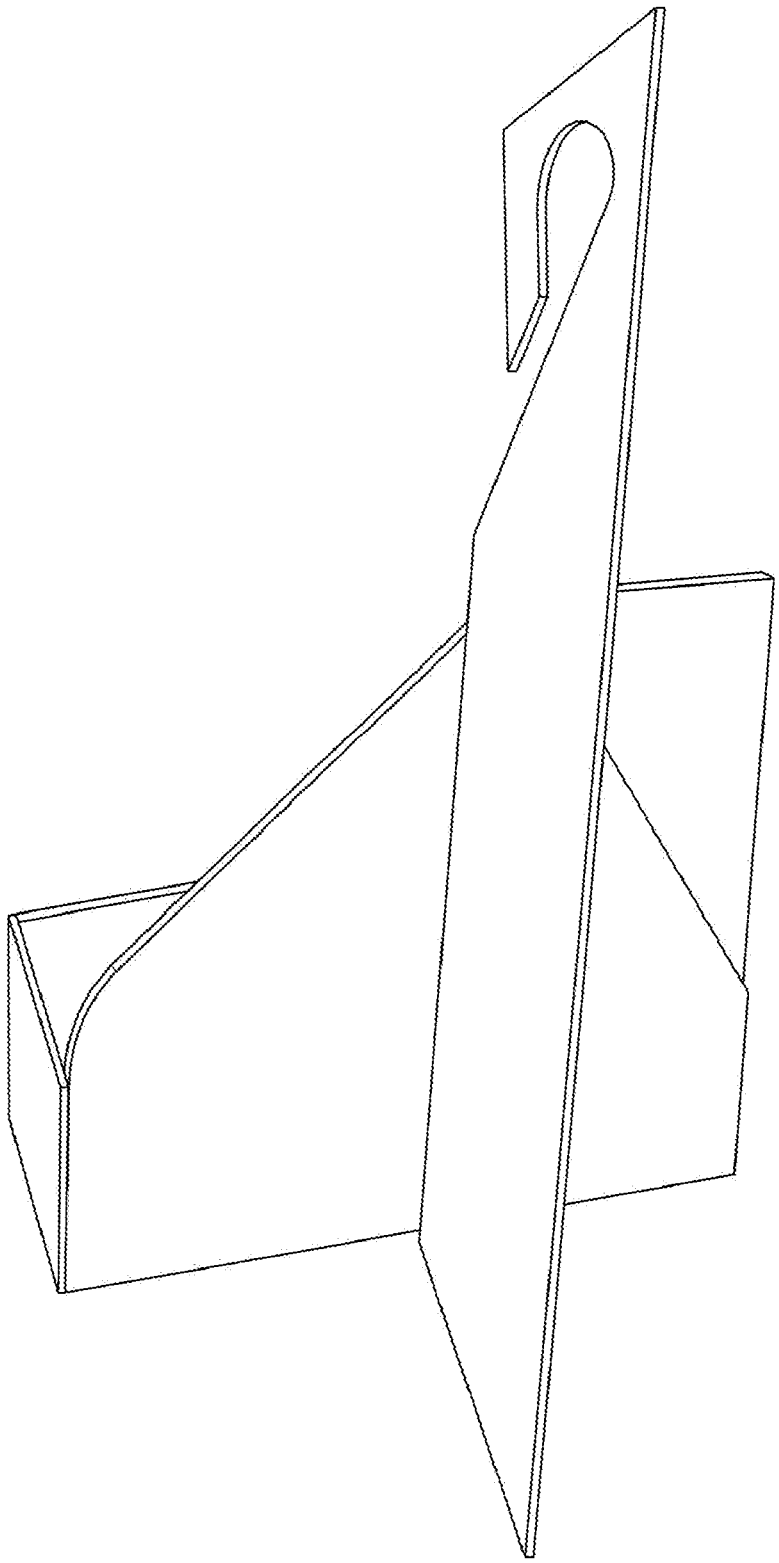
FIG. 17 shows a back perspective view of the partially unfolded disposable doorknob delivery tray.

5—Handle
10, 15—Suction cups
20—Cutouts for drainage
25—Wire basket
30—Clip for notes or receipts
35—Detachable bottom
40—Connector clips
45—Hanging back component
50—Holding tray
55, 60—Drink compartment
65—Food compartment

The invention claimed is:

1. A doorknob delivery tray comprising a component for hanging and delivering the tray, a holding tray, suction cups, three food or drink compartments, connector clips, a clip for notes or receipts, and a bottom comprising a wire basket or a high-density polyethylene basket.

2. The doorknob delivery tray of claim 1, wherein the component can be removed and reattached using the connector clips to accommodate different door orientations.

3. The doorknob delivery tray of claim 1, wherein the tray has three compartments to hold two drinks and a standard fast-food bag.

4. The doorknob delivery tray of claim 1, wherein the suction cups are attached to a back of the tray to provide additional support and accommodate the weight of food and drinks.

5. The doorknob delivery tray of claim 1, wherein the clip for notes or receipts is attached to the component.

6. The doorknob delivery tray of claim 1, wherein the wire basket is configured to allow for fluids to drain in the event of a spill.

7. The doorknob delivery tray of claim 1, wherein the high-density polyethylene basket comprises cutouts which allows for fluids to drain in the event of a spill.

* * * * *